United States Patent [19]

Hayes

[11] Patent Number: 4,568,023

[45] Date of Patent: Feb. 4, 1986

[54] UNIFORM MOTION OSCILLATORY WAVE SPRINKLER

[75] Inventor: Jerry R. Hayes, Peoria, Ill.

[73] Assignee: L. R. Nelson Corporation, Peoria, Ill.

[21] Appl. No.: 509,800

[22] Filed: Jun. 30, 1983

[51] Int. Cl.[4] ..... B05B 3/16

[52] U.S. Cl. ..... 239/242

[58] Field of Search ..... 239/225, 230, 240, 242, 239/214.13, 214.15

[56] References Cited

U.S. PATENT DOCUMENTS

| | | | |
|---|---|---|---|
| 3,063,646 | 11/1962 | Ballard | 239/242 |
| 3,261,553 | 7/1966 | Kooi | 239/242 |
| 3,430,860 | 3/1969 | Chow | 239/242 |
| 3,915,383 | 10/1975 | King | 239/242 |
| 4,245,786 | 1/1981 | Abrahamsen et al. | 239/602 X |
| 4,258,882 | 3/1981 | Hayes | 239/73 |
| 4,340,177 | 7/1982 | Huber | 239/242 |

FOREIGN PATENT DOCUMENTS

| | | | |
|---|---|---|---|
| 673643 | 11/1963 | Canada | 239/310 |

*Primary Examiner*—Andres Kashnikow
*Assistant Examiner*—Kevin Patrick Weldon
*Attorney, Agent, or Firm*—Cushman, Darby and Cushman

[57] ABSTRACT

A uniform water pattern oscillating wave type lawn sprinkler in which the impeller has a dynamic impeller ratio as herein defined of less than approximately 0.30, the reduction gear assembly has a gear reduction ratio of greater than approximately 400 to 1 and an efficiency of at least 26% preferably 39% or greater and the heart-shaped cam motion-transmitting mechanism has a heart-shaped cam with a cam factor as herein defined of less than approximately 3 so as to enable said housing structure to be an optimal minimum in size.

13 Claims, 12 Drawing Figures

UNIFORM MOTION OSCILLATORY WAVE SPRINKLER

This invention relates to sprinkling and more particularly to improvements in lawn sprinklers of the oscillatory wave type.

The type of oscillatory wave sprinklers herein contemplated are well known in the art and have been accepted commercially for many years. Typically an oscillatory wave sprinkler includes a housing structure having an inlet adapted to be communicated with a source of water under pressure which is directed onto the periphery of an impeller mounted within the housing structure. The water after impinging on the impeller passes outwardly of the housing structure into an elongated sprinkler tube which usually is arched upwardly and mounted for turning movements about a generally horizontally extending axis. The rotational movement of the impeller is transmitted through a gear reduction assembly to an output shaft which extends outwardly of the housing with its axis generally parallel to the axis of turning movement of the sprinkler tube. Finally, an adjustable motion transmitting mechanism is provided between the output shaft and the sprinkler tube to impart oscillatory turning movements to the sprinkler tube in response to the rotational movements of the output shaft.

The overwhelming majority of the oscillatory wave sprinklers presently on the market embody a motion transmitting mechanism between the output shaft and the sprinkler tube which is essentially nothing more than an adjustable connecting rod. The connecting rod essentially imparts a simple harmonic wave oscillatory motion to the sprinkler tube.

It has long been known in the oscillatory wave sprinkler art that the turning of the sprinkler tube with a simple harmonic motion results in a somewhat uneven distribution of the water by the sprinkler tube onto the pattern area to be irrigated. Typically, the ends of the pattern receive considerably more water than the central portion of the pattern.

In order to distribute the water within the watering pattern more uniformly there have been provided heart-shaped cam uniform motion-transmitting mechanisms for use in lieu of the typical connecting rod harmonic motion-transmitting mechanisms. Commonly assigned U.S. Pat. No. 3,063,646 dated Nov. 13, 1962 (see also U.S. Pat. No. 3,261,553) discloses an oscillatory wave sprinkler embodying a heart-shaped cam uniform motion-transmitting mechanism. The sprinkler of the patent has been available commercially for many years and, in fact, has enjoyed considerable acceptance as being a top-of-the-line sprinkler. Specifically, the sprinkler as disclosed in the patent and as sold commercially embodies a relatively large water motor. The term water motor as herein utilized comprehends within its meaning the combination of both the impeller and the gear reduction assembly which functions to impart a slower rotational speed to the output shaft in response to the more rapid rotational speed of the impeller. Heretofore the sprinklers which embodied the heart-shaped cam uniform motion-transmitting assembly have been utilized with relatively large water motors because of the known greater torque requirements of a heart-shaped cam motion-transmitting mechanism, as compared with a simple harmonic motion connecting rod mechanism. For this reason insofar as the commercial practice to date is concerned, the only oscillatory wave type sprinklers having uniform patterns have been those which are sold for a premium price. The majority of the more economical oscillatory wave type sprinklers have all utilized the simpler harmonic motion connecting rod motion-transmitting assemblies which are known to require less torque, and hence capable of being operated with water motors of relatively small capacity within minimum size housings. To restate the proposition in different language, because of the heretofore conceived need to provide a larger water motor to accommodate the larger torque requirements of a heart-shaped cam and the resultant larger housing, the uniform pattern wave sprinklers commercially have not been heretofore price competitive with the harmonic wave sprinklers which utilized small water motors in minimum size housings suitable to drive the simpler connecting rod mechanism with its lower torque requirements.

It is an object of the present invention to provide an improved oscillatory wave type sprinkler which achieves the advantages of both the uniform pattern of premium priced sprinklers and the economy qf harmonic motion type sprinklers without the disadvantage of either. In accordance with the principles of the present invention this objective is obtained by utilizing certain dynamic relationships and resultant structures in the water motor and heart-shaped cam assembly which makes it possible to effectively drive a heart-shaped cam motion-transmitting mechanism with a relatively small water motor. More specifically, with respect to the heart-shaped cam motion-transmitting mechanism that it must have a cam factor as hereinafter defined of less than approximately 3. The water motor must provide an impeller having a dynamic impeller ratio as hereinafter defined of less than approximately 0.3 and a gear reduction assembly having a gear reduction ratio of greater than approximately 400 to 1 and an efficiency of at least 26% and preferably 39% or greater. In accordance with the principles of the present invention, when these relationships are provided the housing structure of the sprinkler is enabled to be an optimal minimum in size so that the resultant sprinkler compares economically with the more economical small water motor sprinklers heretofore provided on the market which utilized simple harmonic motion in the sprinkler tube.

These and other objects of the present invention will become more apparent during the course of the following detailed description and appended claims.

The invention may best be understood with reference to the accompanying drawings wherein an illustrative embodiment is shown.

Figure 6:
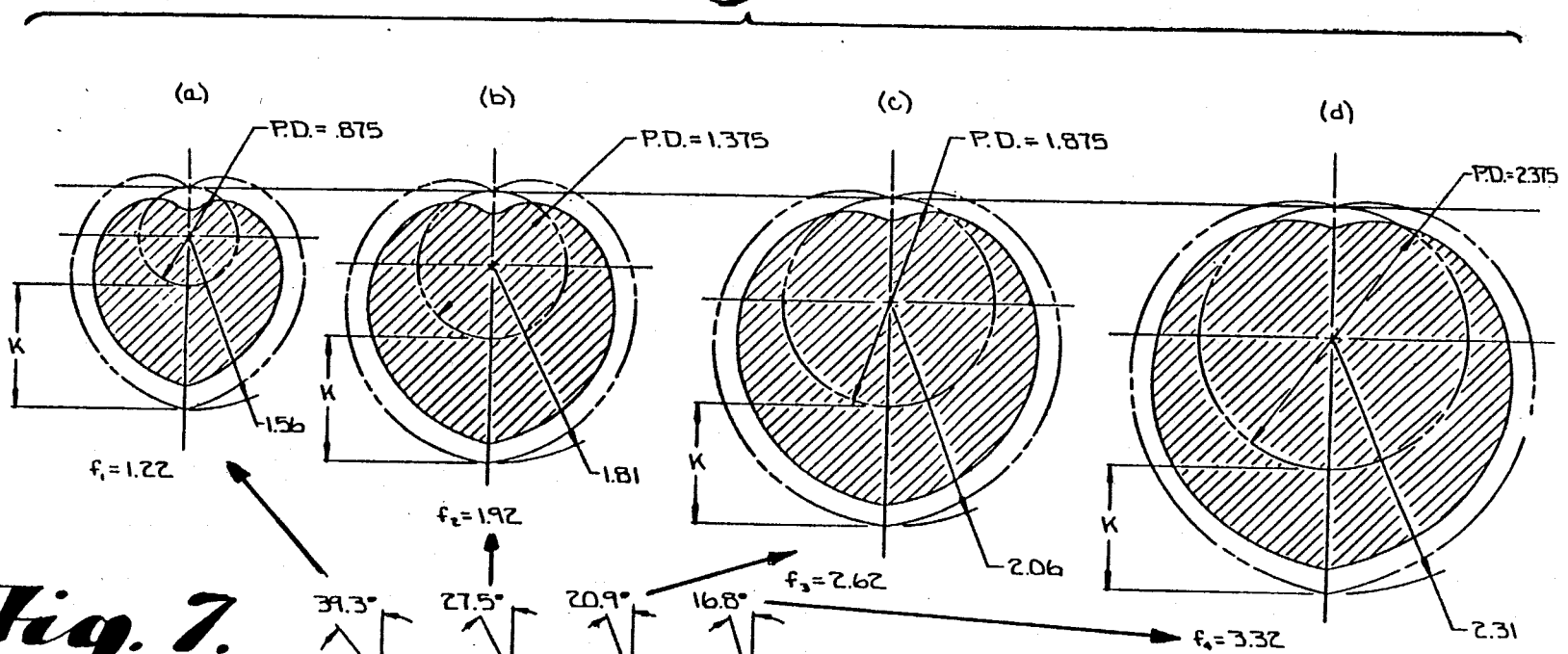
Figure 7:
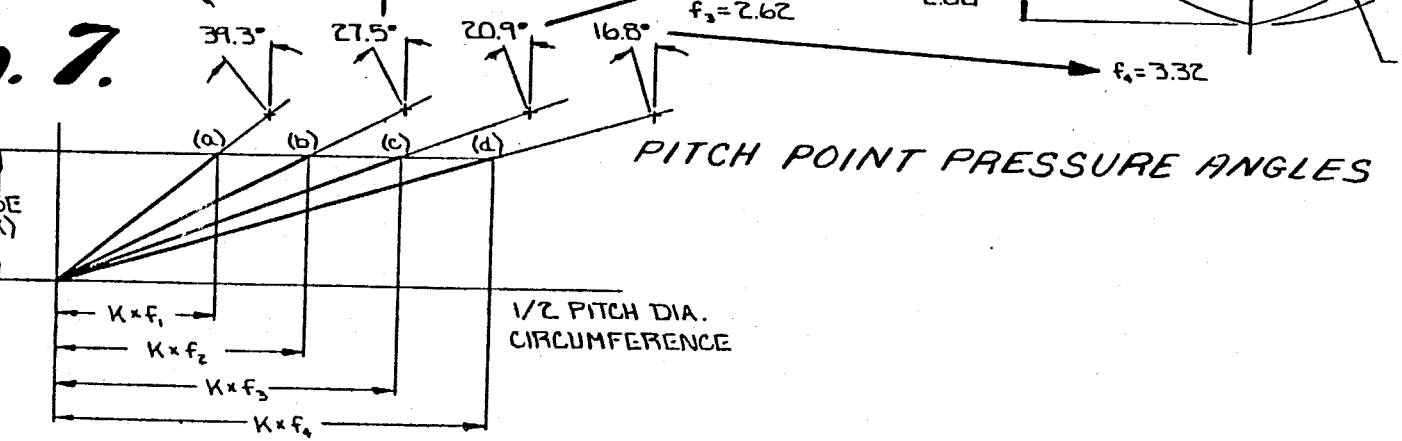
Figure 8:
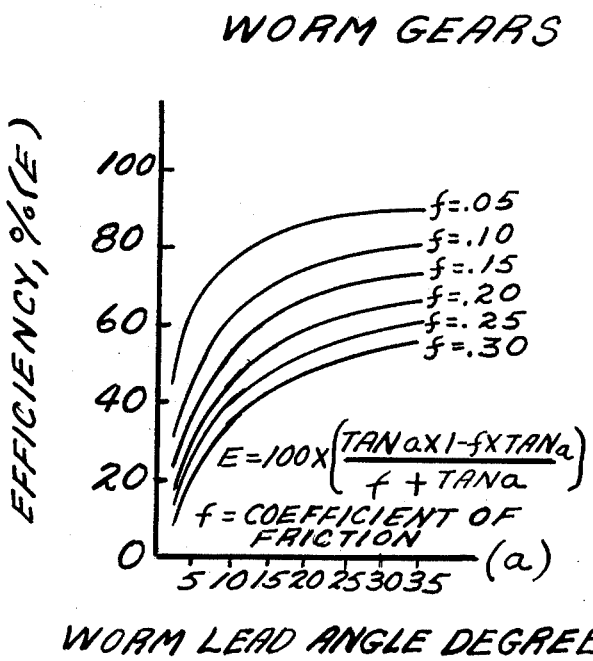
Figure 10:
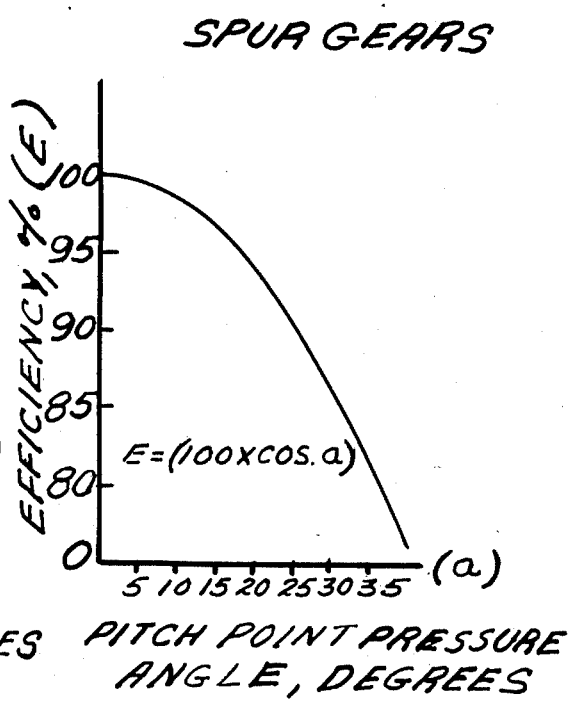
Figure 9:
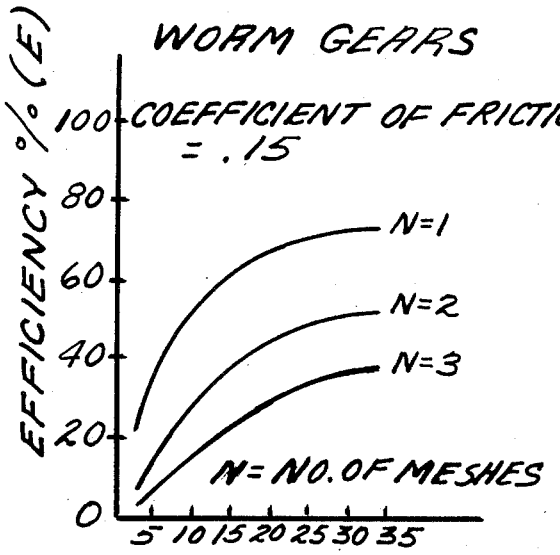
Figure 11:
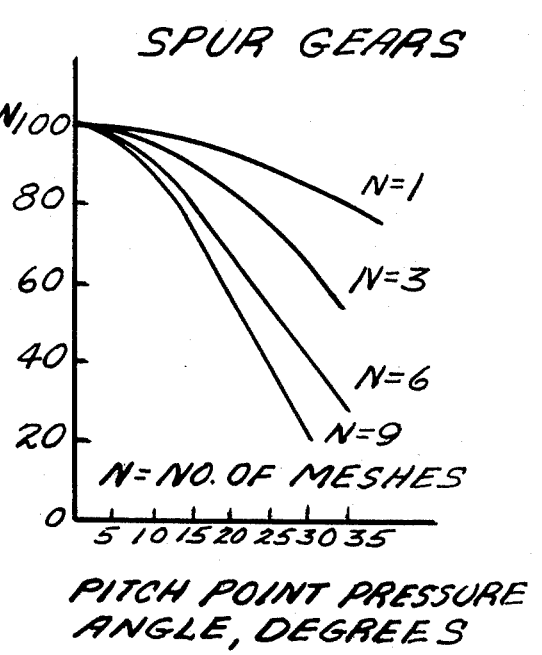
Figure 12:
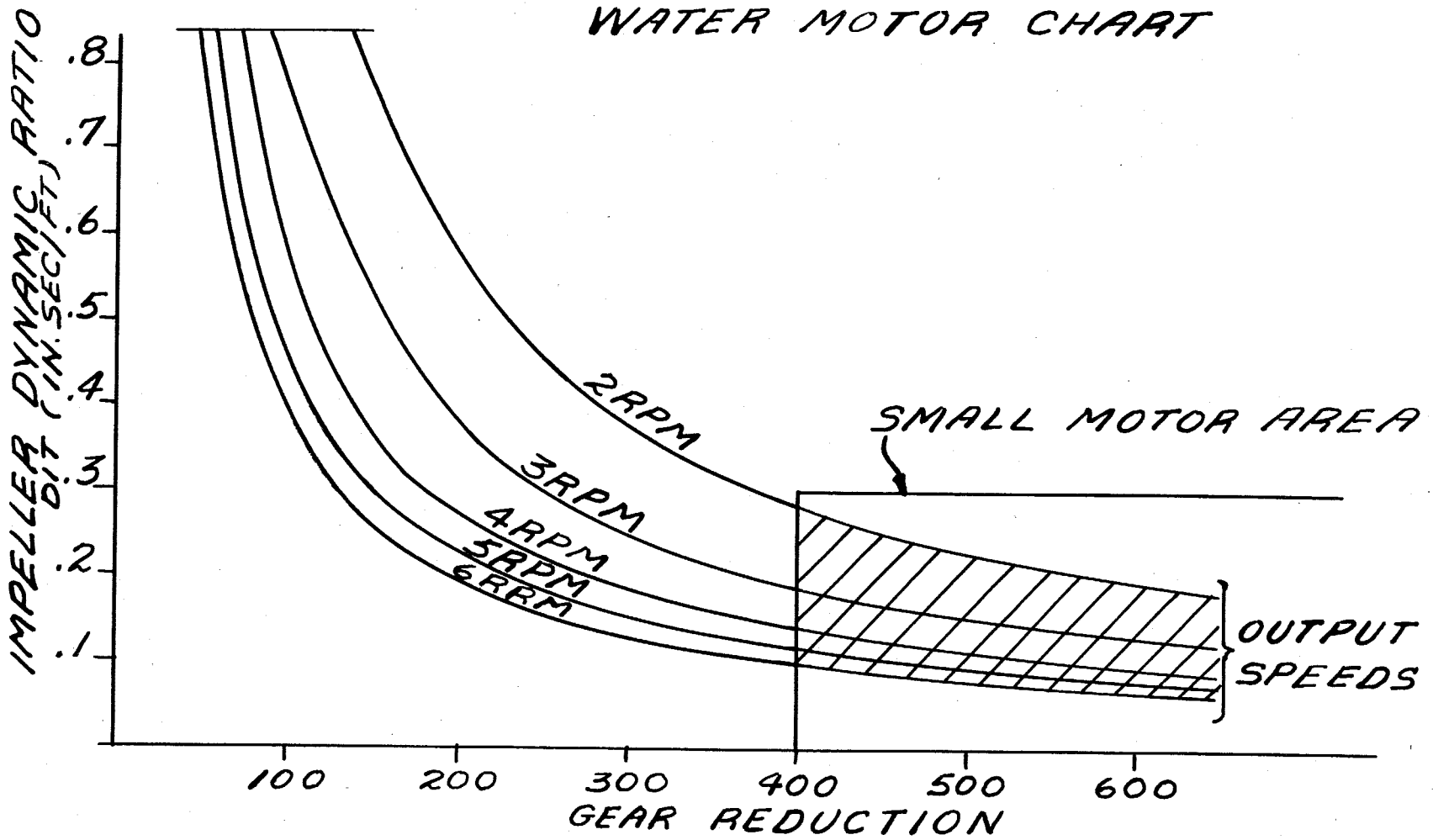

FIGS. 6(*a*) to (*d*) are a series of diagrammatic views illustrating exemplary variable cam configurations;

FIG. 7 is a graph depicting the family of curves derived from the variable cam configurations set forth in FIGS. 6(*a*) to (*d*);

FIG. 8 is a graph depicting the family of curves obtained by plotting efficiency of a worm gear pair against worm gear angle for various coefficients of friction;

FIG. 9 is a graph depicting the family of curves obtained by plotting efficiency of total gear train against worm gear angle for various numbers of pairs of meshing worm gears within the train;

FIG. 10 is a graph of a curve obtained by plotting efficiency of a meshing spur gear pair against the pitch point pressure angle;

FIG. 11 is a graph depicting the family of curves obtained by plotting efficiency of total gear train against pitch point pressure angle for various numbers of pairs of meshing spur gears within the train; and FIG. 12 is a water motor chart plotting the dynamic ratio of the impeller against the gear reduction provided by the reduction gear assembly serving to drivingly connect the impeller to the output shaft of the sprinkler.

Figure 1:
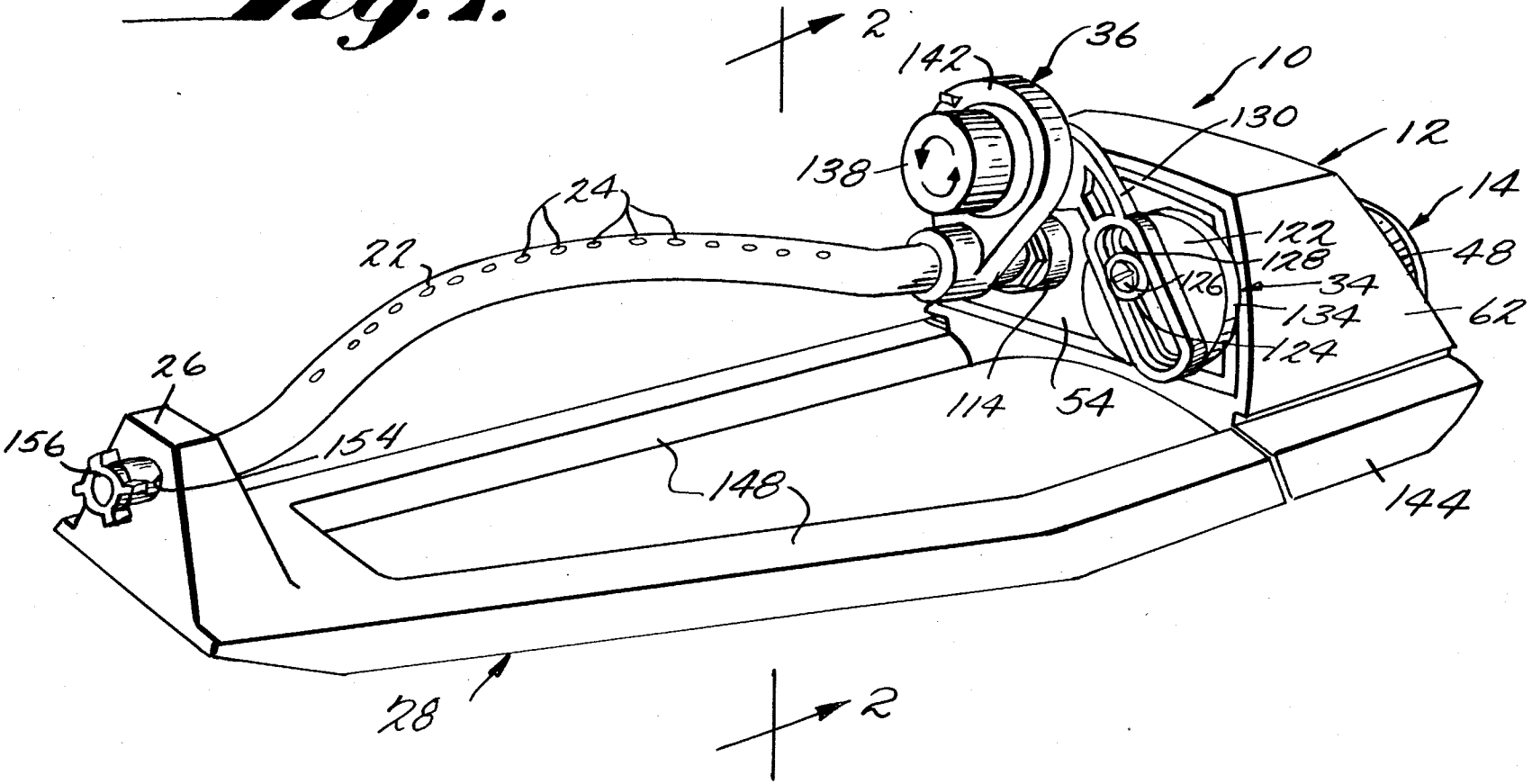
FIG. 1 is a perspective view of a sprinkler embodying the principles of the present invention.
Figure 2:
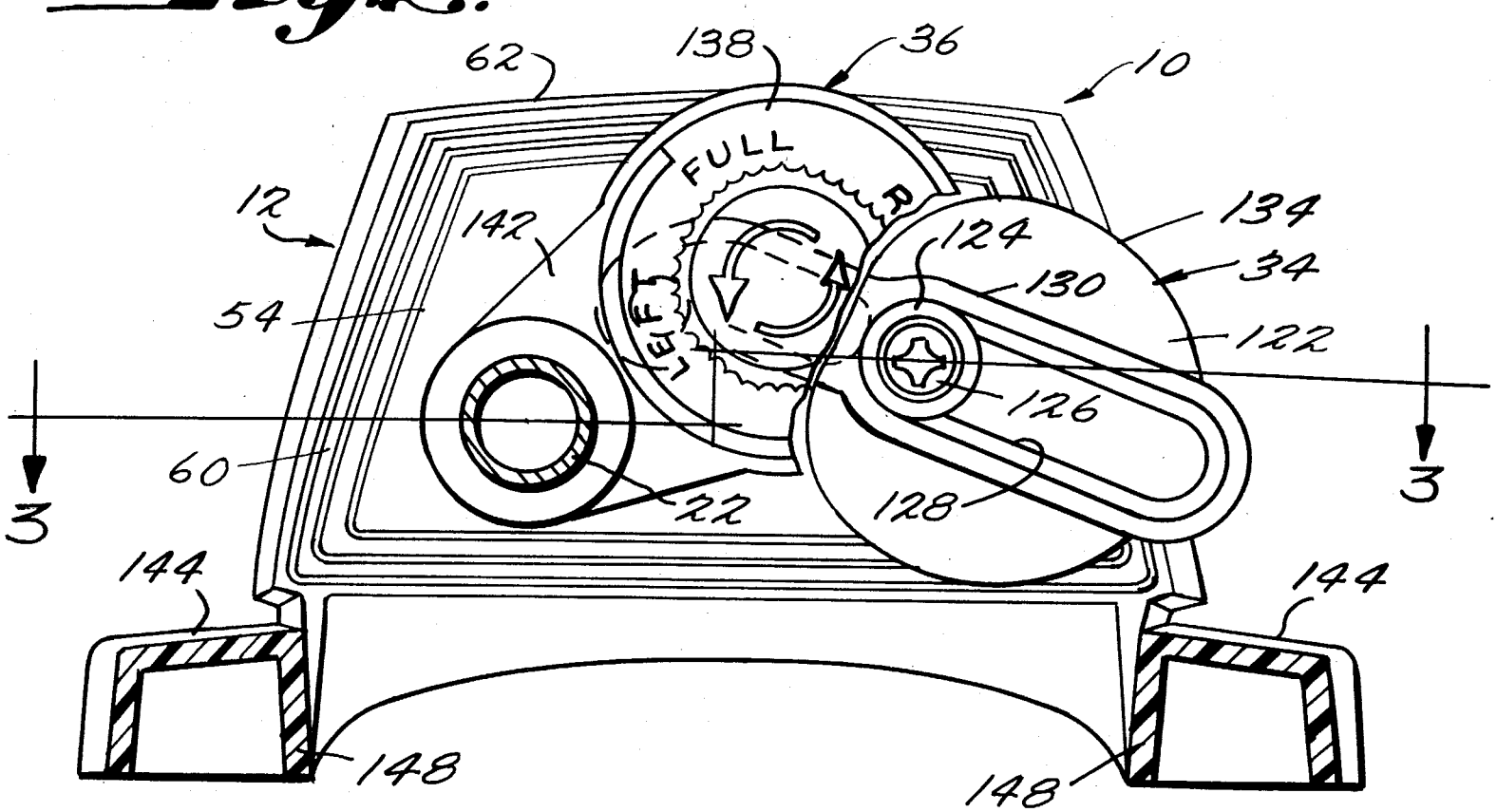
FIG. 2 is an enlarged fragmentary sectional view taken along the line 2—2 of FIG. 1.

Referring now more particularly to the drawings, there is shown therein an oscillatory wave type sprinkler, generally indicated at 10, embodying the principles of the present invention. The sprinkler 10 includes a housing structure, generally indicated at 12, having an inlet assembly 14 adapted to be connected with a source of water under pressure, an impeller 16 rotatably mounted within the housing structure in a position to receive water under pressure from a discharge opening 18 (see FIG. 4) in the inlet assembly so as to cause rotational movement of the impeller. The water from the inlet including the water directed toward the impeller passes outwardly of the interior of the housing structure through an inlet end portion 20 (see FIG. 3) of a sprinkler tube 22. As best shown in FIG. 1, the sprinkler tube 22 is upwardly bowed and is provided with a series of longitudinally spaced outlet openings 24. The inlet end portion 20 of the sprinkler tube 22 is supported within the housing structure 12 for turning movement about a generally horizontally extending axis and the outer end portion thereof is supported for turning movements about the same axis at the outer end portion 26 of a runner assembly 28. Drivingly connected with the impeller 16 is a gear reduction assembly, generally indicated at 30 (see FIGS. 3 and 4), the output of which serves to drive an output shaft 32 mounted for rotational movement on the housing structure 12 for movement about a rotational axis parallel with the turning axis of the sprinkler tube 22. Connected between the sprinkler tube 22 and output shaft 32 is a heart-shaped cam motion-transmitting mechanism, generally indicated at 34. The mechanism 34 includes an adjustable dial assembly 36 which may be manually moved to select one of four different pattern configurations in accordance with conventional practice.

Figure 4:
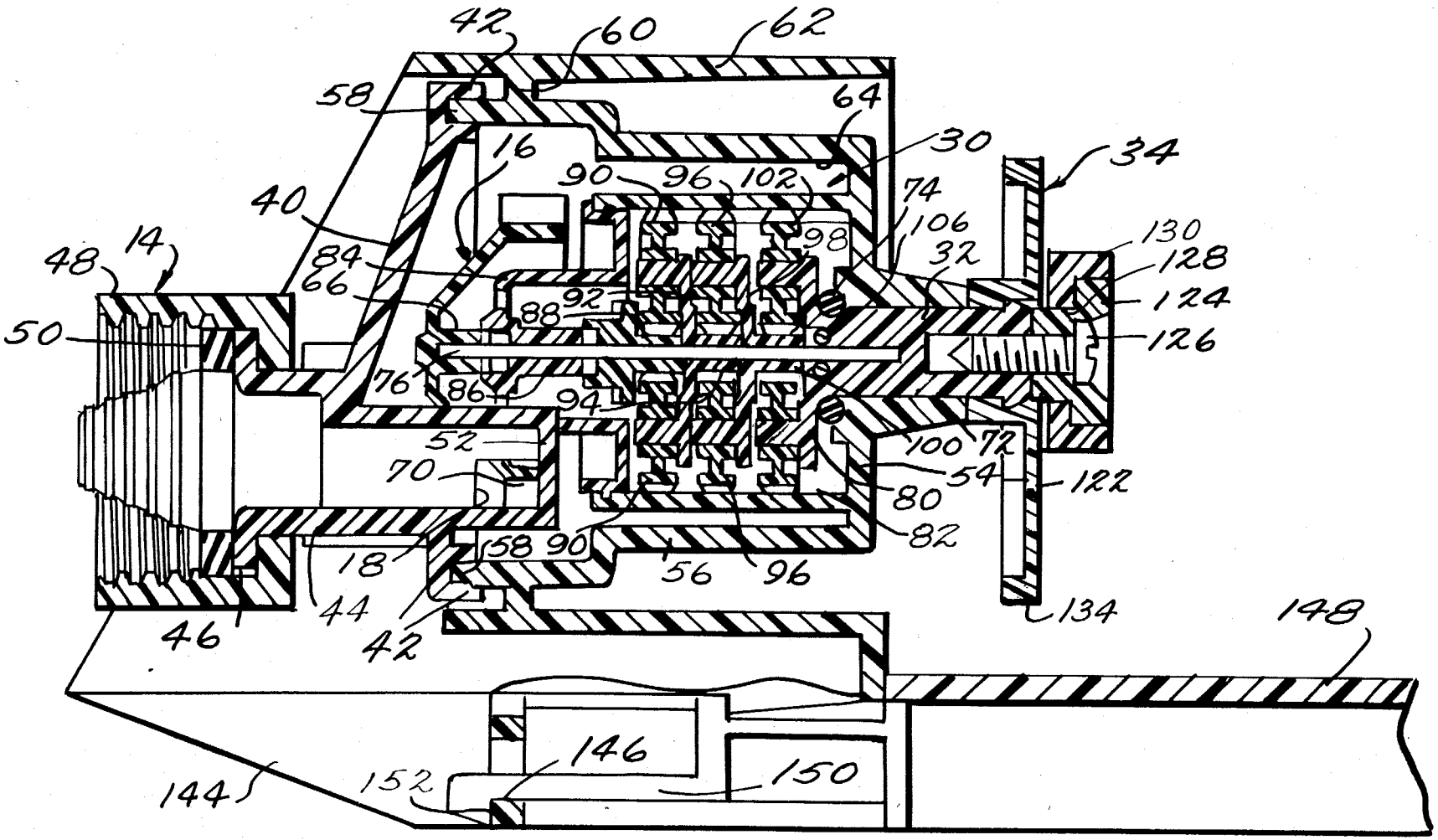
FIG. 4 is a sectional view taken along the line 4—4 of FIG. 3.

The housing structure 12 is preferably molded of a suitable plastic material of two separate parts rigidly secured together. Any suitable plastic may be utilized, an exemplary embodiment is ABS terpolymer medium impact. As shown, one part of the two-part housing structure 12 consists essentially of a generally trapezoidal shaped rear wall 40 having a forwardly directed dual peripheral flange configuration 42 integrally formed on the periphery thereof. The rear wall 40 receives the inlet assembly 14 therethrough and, as best shown in FIG. 4, the inlet assembly is in the form of an integral tubular portion 44 extending through the lower central portion of the rear wall 40 having an exterior portion defined by an outwardly directed flange 46. The inlet assembly 14 includes a conventional female coupling member 48 which is rotatably received on the annular flange 46 and has a washerstrainer unit 50 disposed interiorly thereof for enabling the female coupling member 48 to be sealingly engaged with a male coupling member (not shown) forming a part of a garden hose or the like which serves to communicate a source of water under pressure with the inlet assembly 14. As best shown in FIG. 4, the tubular portion 44 extends forwardly of the rear wall 40 and has its forward extremity closed by an integral wall 52. It will be noted that the discharge opening 18 of the inlet assembly 14 is formed in the periphery of the tubular portion 44 adjacent the end wall 52.

The second part of the two-piece housing structure 12 provides a forward or front wall 54 disposed in spaced relation to the rear wall 50 and a continuous peripheral wall 56 extending rearwardly from the periphery of the front wall 54 and having a rearwardly directed peripheral edge 58 shaped to matingly engage within the peripheral dual flange 42 directed forwardly from the rear wall 40. Preferably, the interconnection between the edge 58 and dual flange 42 is sonically welded to fixedly secure the two parts of the housing structure together. Extending outwardly from the peripheral wall 56 in closely spaced relation to the peripheral edge 58 thereof is a peripheral flange 60. Formed integrally on the outer extent of the peripheral flange 60 is a peripheral shielding wall 62 which surrounds the peripheral wall 56 in radially spaced relation with respect thereto.

Figure 3:
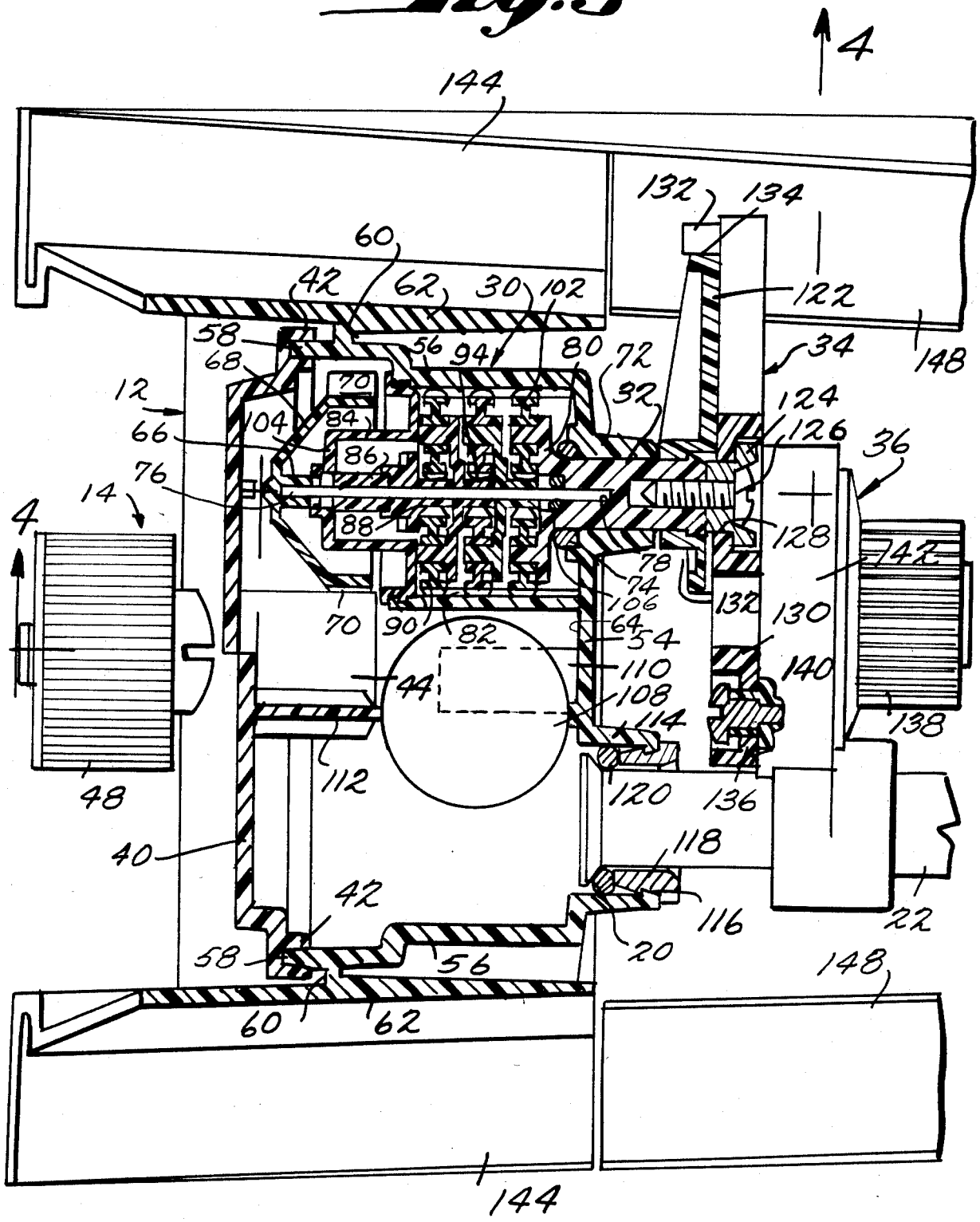
FIG. 3 is a sectional view taken along the line 3—3 of FIG. 2.

The interior of the housing structure 12 provides a sealed water containing space 64 which is defined by the interior of the peripheral wall 56 between the rear and front walls 40 and 54. Water is received within the space 64 through inlet opening 18 which serves to direct an inlet stream onto the impeller 16 so as to rotate the same. As best shown in FIGS. 3 and 4, the impeller 16 includes a hub portion 66 having an annular rotor member 68 fixed to one end thereof and extending outwardly therefrom. The annular member has formed on the exterior periphery thereof a multiplicity of annularly spaced impeller blades 70. As best shown in FIG. 4, the impeller 16 is mounted so that the impeller blades 70 in the lower peripheral portion thereof are disposed within the inlet stream of water issuing into the water space 64 through the inlet opening 18. The flow of water through the inlet thus serves to rotate the impeller about its axis of rotation.

As shown, the impeller 16 is mounted so that its axis of rotation is coincident with the axis of rotation of the output shaft 32. As best shown in FIGS. 3 and 4, the central exterior periphery of the output shaft 32 is journaled within a boss 72 formed integrally within the front wall 54 of the housing structure 12. An annular O-ring seal 74 is provided between the boss 72 and the output shaft 32 within the space 64 so as to prevent leakage of water within the space 64 outwardly of the periphery of the output shaft 32. The impeller 16 is rotatably supported within the space 64 by fixedly engaging the hub portion 66 thereof to one end of an impeller shaft 76. The impeller shaft 76 is of a diameter size considerably less than the diameter size of the output shaft 32 and its opposite end is journaled within a bore 78 formed in an interior end portion 80 of the output shaft 32.

The reduction gear assembly 30 is drivingly connected between the impeller 16 and output shaft 32 and preferably is a planetary gear assembly of the type described in commonly assigned U.S. Pat. No. 3,915,383, the disclosure of which is hereby incorporated by reference into the present specification. Specifically, all of the movable gears of the planetary gear assembly are spur gears and the assembly includes an axially elongated orbit ring gear 82 which preferably is molded integrally as a forwardly extending portion of the front wall 54 of the associated housing part in concentric relation with the boss 72.

As best shown in FIGS. 3 and 4, the end of the impeller shaft 76 adjacent the impeller 16 is rotatably supported by an annular support member 84 of molded plastic material having a peripheral snap fitting within the forward interior periphery of the ring gear 82. A support member 84 includes a hub portion 86 disposed forwardly of the impeller hub portion 66 which rotatably receives the impeller shaft 76. A first sun gear 88 is suitably fixed to the impeller shaft 76 forwardly of the hub portion 86. The sun gear 88 meshes with a first set of two diametrically opposed planetary gears 90 which also mesh with ring gear 82. Planetary gears 90 are rotatably supported on a first gear carrier 92 having an integral forwardly extending second sun gear 94 rotatably mounted on the impeller shaft 76. A second set of two diametrically opposed planetary gears 96 is disposed in meshing engagement with the sun gear 94 and ring gear 82. Planetary gears 96 are rotatably supported in a second gear carrier 98 having an integral forwardly extending third sun gear 100 rotatably mounted on the impeller shaft 76. Sun gear 100 meshes with a third set of three planetary gears 102 which also mesh with ring gear 82. The interior end 80 of the output shaft 32 is configured to act as a third gear carrier for the third set of planetary gears 102. Water within space 64 leaves the space through the inlet end portion 20 of the sprinkler tube 22. An O-ring seal 106 is mounted within a counterbore to the bore 78 in exterior peripheral sealing relation with the impeller shaft 76 to provide a fractional retaining force to the planetary gear reduction assembly during the manufacturing process.

Mounted within the central forward portion of the space 64 alongside the ring gear 82 is a housing weight in the form of a metal ball 108. Ball 108 is supported within three integral support elements 110 extending rearwardly from the front wall 54 of the associated housing part and immovably retained therein by an integral retaining element 112 extending forwardly from the rear wall 40 of the associated housing part.

As best shown in FIG. 3, the inlet end 20 of the sprinkler tube 22 is flared outwardly to a dimension which will pass through a boss 114 formed in the front wall 54. Boss 114 includes an inwardly directed annular barb 116 on its forward end which is adapted to snap within an exterior groove formed in the periphery of a mounting sleeve 118 engaged over the adjacent exterior periphery of the sprinkler tube 22. An O-ring seal 120 abutting the inner end of sleeve 118 provides a water-tight seal between the flared exterior periphery of the end portion 20 of the sprinkler tube 22 and the interior periphery of the housing boss 114. In this way the interior end 20 of the sprinkler tube is sealingly mounted for turning movements about an axis which is parallel to the axis of output shaft 32.

It will be understood that output shaft 32 preferably constitutes a plastic molded part which facilitates the formation of the integral gear carrier configuration of the interior end portion 80 thereof. The exterior end portion is formed into an exteriorly barbed and splined configuration to matingly receive the hub of a cam member 122, forming a part of the heart-shaped cam motion-transmitting mechanism 34. The cam member 122 is retained in fixed relation on the exterior end of the output shaft 32 by an exteriorly flanged button 124 and concentric screw 126. The flange button 124 slidingly engages within a slot 128 formed in one end portion of a cam follower member or link 130. Link 130 has a pair of integral cam follower elements 132 extending laterally therefrom at opposite ends of the slot 128 for engaging a heart-shaped cam surface 134 formed on the exterior periphery of the cam member 122. The opposite end of the link 130 is apertured to receive a laterally extending pivot element 136 formed integrally on a rotary dial or knob member 138 in eccentric relation to its axis. A screw 140 serves to secure the pivotal connection between the dial member 138 and the link 130 provided by pivot element 136. The rotary dial member 138 forms one part of two parts of the adjustable dial assembly 36 which preferably is constructed in accordance with the teachings contained in commonly assigned U.S. Pat. No. 4,258,882, the disclosure of which is hereby incorporated by reference into the present specification. The second part is in the form of a dual ring member 142, one ring of which receives the rotary dial member 138 for snap action indexed rotary movement and the other ring of which fixedly engages the exterior periphery of the sprinkler tube 22 adjacent the interior end portion 20 thereof.

The runner assembly 28 is formed by a pair of rear runner elements 144 formed integrally with the housing part defining the shielding wall 62. The rear runner elements extend downwardly on opposite sides of the lower portion of the peripheral shielding wall 62 and define interiorly a pair of forwardly open sockets 146. The outer end portion 26 of the runner assembly 28 is provided as an integral plastic molded part with a pair of runners 148. The runners are provided with snap action end portions 150 of a configuration suitable to be moved into the associated interior sockets 146 and to be fixedly secured therein by a snap action through interengaging snap action hook portions 152, as shown in FIG. 4. It will be noted that the outer end portion 26 of the runner assembly 28 is apertured as indicated at 154 to rotatably receive therein the outer end portion of the sprinkler tube 22. The outer end of the sprinkler tube 22 is closed by a plug member 156.

The improvements of the present invention are particularly concerned with the construction of the heart-shaped cam motion-transmitting mechanism 34 and the water motor mounted within the housing structure 12 which embodies the combination of the impeller 16 and the reduction gear assembly 30.

Figure 5:
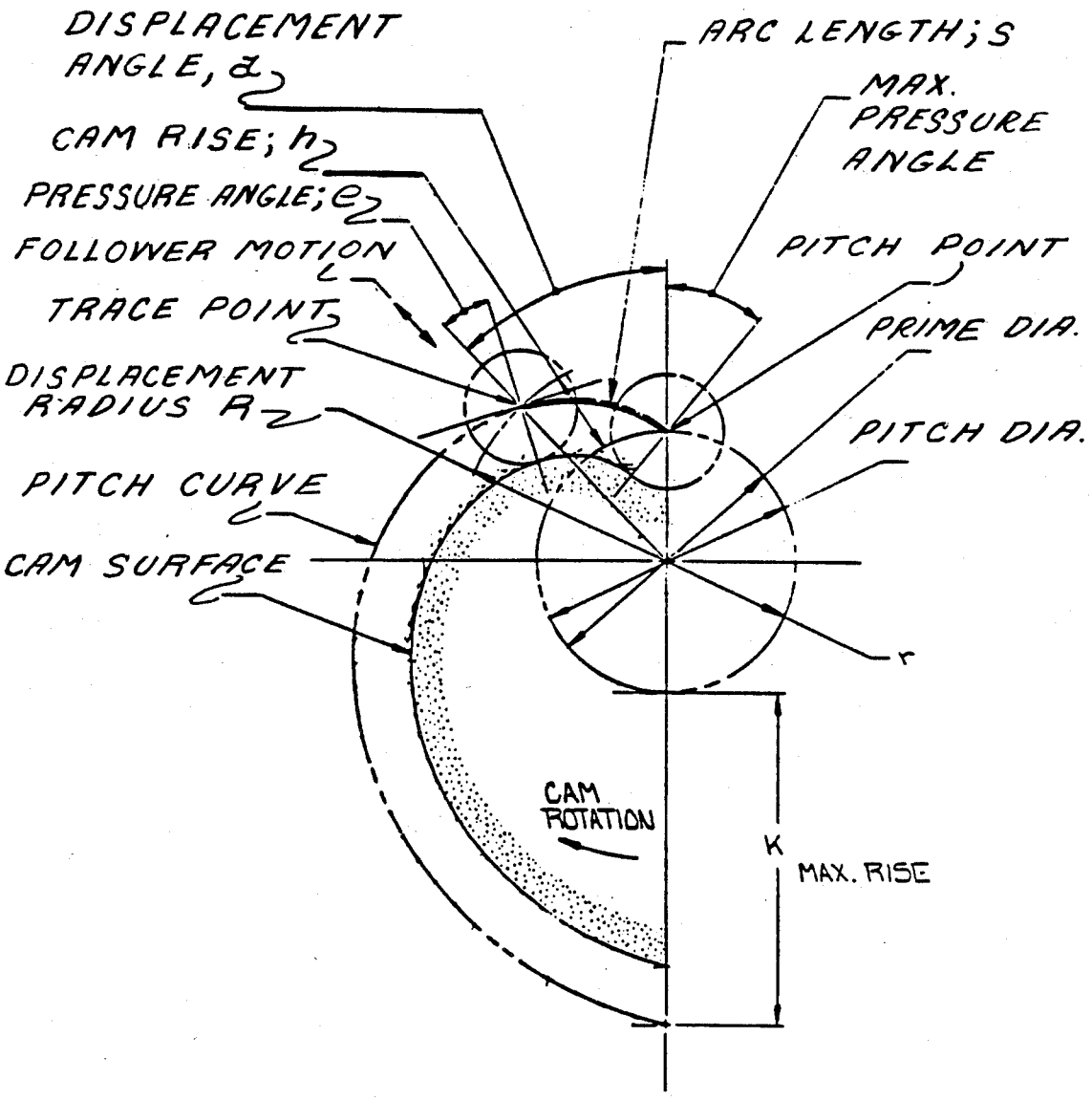
FIG. 5 is a diagrammatic view illustrating certain terminology relating to the heart-shaped cam motion-transmitting mechanism.

With respect to the heart-shaped cam member 122 it has been found that the relatively high torque requirements heretofore attributed to uniform motion cams of this configuration are most importantly affected by the pressure angle. A graphic representation of the pressure angle is depicted in FIG. 5. The pressure angle is the angle between the direction of the follower motion and a normal to the pitch curve. The pitch curve is the curve generated by the trace point which is the center point of a circular follower contacting on the cam surface 134. The pitch point designated in FIG. 5 is the closest location of the trace point to the cam center. The pitch circle is the circle drawn from the cam center through the pitch point. The cam rise is the maximum distance the trace point moves from the pitch circle during the cam rotation from the pitch point along the pitch curve for 180°. Since the cam is a uniform motion cam the rate that the rise changes is constant for any angular displacement angle.

In order to reduce the peak torque requirements it is desirable to reduce the pitch point pressure angle. This can be done by making the cam larger. As the cam is enlarged not only is the cost of the cam increased but more importantly the size and hence the cost of the housing structure necessary to support the cam is also increased. This is particularly true since the sprinkler tube 22 must be spaced from the cam member 122 in order to provide clearance.

FIGS. 6(*a*) to (*d*) illustrate that for a given cam rise required to achieve the desired water pattern a cam factor (f) can be derived to quantify a cam size and pitch point pressure angle relationship which is defined as the ratio of ½ the circumference of the pitch circle to the cam rise. As before, since the cam is a symmetrical cam an angular displacement of 180° can be chosen as relating to the maximum rise. Consequently, the cam factor (f) can be expressed as $\pi r$ over K where r is the radius of the pitch circle and K is the maximum cam rise.

In FIG. 6 there is shown a series of four different cam sizes, each of which will produce the same required maximum cam rise (K) (e.g. 1.125"). As indicated in FIG. 6, the four sizes are equivalent to cam members having a pitch diameter of 0.875", 1.375", 1.875" and 2.375" respectively. The cam factor (f) relating to each size is also indicated in FIG. 6. FIG. 7 graphically illustrates the cam factor for the four cam sizes as straight lines when plotting cam rise against the length of the arc of the pitch circle up to $\pi r$. Also illustrated in FIG. 7 are the corresponding pitch point pressure angles for each of the cam factor constants.

With the above in mind it has been found that a heart-shaped cam with a cam factor less than approximately 3 can be driven by a carefully chosen small water motor and does not require the relatively large water motor heretofore deemed necessary. FIG. 12 graphically illustrates the characteristics of the small water motor which may be utilized in terms of a characteristic of the impeller 16 and the speed ratio of the reduction gear assembly 30. First, with respect to the reduction gear assembly 30, in order to achieve a desirable speed for the output shaft 32, it is essential that the speed ratio be greater than approximately 400 to 1. Second, it is essential that the reduction gear assembly 30 be a relatively efficient gear train. Double worm gear trains such as utilized in U.S. Pat. No. 3,063,646 are relatively inefficient and cannot be utilized in accordance with the principles of the present invention.

For the sake of simplicity and clarity, efficiency as herein defined is calculated on a static basis rather than dynamic basis. In order to clearly indicate the static basis of efficiency herein utilized reference is made to the graphs shown in FIGS. 8–11 of the drawings. FIG. 8 illustrates a family of curves derived with respect to a meshing worm gear pair by plotting static efficiency against variations in the worm lead angle for various coefficients of friction. In the graph the efficiency is calculated with the use of the formula $$E = 100 \times \frac{\tan a \times 1 - F \times \tan a}{f + \tan a}$$

where E is efficiency in percentage, a is the worm lead angle in degrees, and f is the coefficient of friction which is a known value depending upon the material of the meshing worm and worm gear. This formula is derived on the basis of the following consideration. A worm gear is nothing more than an inclined plane whose slope is the same as the lead angle of the worm; i.e., the helix angle (a) of the thread measured from a plane perpendicular to the work axis. The lead (L) of the worm thread is the advance generated parallel to the worm axis for one revolution of the worm. Consequently, the tangential function of the helix angle (a) is equal to L divided by 2 $\pi r$ where r is the pitch radius of the worm. With the coefficient of friction between the worm and the worm gear being designated as (f), the input torque (t) at the worm required to overcome a resistent torque (T) at the worm gear with a pitch radius of (R) may be expressed as:

$$t = T(r/R)\frac{\sin a + f\cos a}{\cos a - f\sin a} \quad (1)$$

If the friction were non-existent, then equation (1) reduces to:

$$t = T(r/R)\tan a. \quad (2)$$

The efficiency formula of the worm to worm gear mesh is found by substituting equation (1) and (2) in the equation:

$$\text{Eff} = 100 \times \text{Equation (2)/Equation (1)}. \quad (3)$$

As can be seen from the graph of FIG. 8, efficiency increases as the coefficient of friction is decreased and the worm lead angle is increased. As a practical matter, heretofore the coefficient of friction has been restricted by the economics involved to a value of about 0.15. Moreover, since the worm angle is a direct function of the amount of speed reduction obtained, it has been the practice heretofore to choose a relatively small lead angle of approximately 5° in order to obtain the desired speed reduction. When these values are substituted into the formula set forth above, an efficiency of 35% is derived.

As shown in the graph of FIG. 9, for a given gear train or assembly, the total efficiency is equal to the product of the individual mesh efficiencies of each meshing gear pair in the train. In FIG. 9, efficiency is plotted against worm lead angle, as in FIG. 8, for f=0.15 for a gear train having only one meshing pair, two meshing pairs and three meshing pairs. Thus for the prior art double worm gear train the efficiency is 35%×35% or 13%.

In accordance with the principles of the present invention an efficiency of at least 26% is required, and preferably 39% or greater, in order to insure reliability under all conditions. Preferably, all of the movable gears are spur gears. In general it can be stated that the utilization of inefficient gear meshes in the reduction gear assembly so increases the torque requirements of the impeller (and consequently its size) as to preclude the resultant water motor from being designated a small water motor within the definition hereinafter stated. While the multiple spur gears of the reduction gear assembly may be an array of intermeshing large/small sets of spur gears, it is preferable to utilize a planetary gear system.

FIG. 10 illustrates a graph comparable with the graph of FIG. 8 as it would apply to a meshing spur gear pair rather than a meshing worm and worm gear pair. It will be noted that there is a single curve shown which is efficiency plotted against various pressure point angles. There is no family of curves based upon various coefficients of friction because a spur gear pair meshes for the instant of load transmission at the pitch point exhibit a pure rolling motion. Thus on a static basis, since there is no sliding tendency (at the pitch point), there is no inefficiency due to friction. The loss of torque in this instance is due solely to the effect of the pressure angle, i.e., the input torque (t) required to overcome the resistant torque (T) is $$t = T\,(r/R)/\cos a \qquad (1)$$

where (r) and (R) are the pitch radii of the input and output gear respectively and (a) is the pressure angle of the gear mesh.

For the ideal case of 100% transfer of torque the pressure angle (a) would be zero and equation (1) reduces to:

$$t = T\,(r/R) \qquad (2)$$

The efficiency of this (static) spur gear mesh at the pitch point is found by substituting equation (1) and equation (2) in the following:

$$\text{Eff} = 100 \times \text{Equation (2)/Equation (1)}, \qquad (3)$$

or as indicated in FIG. 10, for a pair of meshing spur gears the formula is $\text{Eff} = 100 \times \cos a$.

The spur gears of the reduction gear assembly 30 have an operating pressure angle (a) of 27°. The efficiency per mesh is therefore 89.1%. Referring to FIG. 11, since there are two distinct meshes per stack and three stacks from input to output, the overall efficiency of the gear train is:

$$\text{Eff (train)} = (0.8910 \times 0.8910)^3 \times 100 = 50\%$$

With respect to the impeller 16 it will be understood that for any water motor there is a limiting physical relationship between the impeller diameter, the impeller tip speed, the output shaft speed and the gear reduction required to obtain that output speed. The output shaft speed for a typical sprinkler is between two to six rpm. Likewise, the input flow rate through the inlet opening will be determined within narrow limits by virtue of the city water main usually or other pressure when the city water main is not used. Since the gear reduction has already been determined, there are left two variables, both of which relate to the impeller and these two variables can be expressed as an impeller dynamic ratio which is the ratio of the impeller diameter to the impeller tip speed. FIG. 12 plots the impeller dynamic ratio required for various speed ratios to achieve output rpm's of the output shaft 32 of two, three, four, five and six. From the graph it can be seen that where a speed reduction ratio of more than approximately 400 to 1 is utilized, the impeller dynamic ratio must be less than approximately 0.3. Where the water motor utilizes an impeller with a dynamic ratio of less than 0.3 with a speed reduction of greater than 400 to 1 utilizing a speed reduction assembly of the type herein described, it has been found that there is by definition a small water motor which it has been found can function quite adequately to drive a heart-shaped cam motion-transmitting mechanism, even if the heart-shaped cam of that mechanism has a cam factor of less than approximately 3. In the exemplary embodiment shown, the cam 122 has a cam factor of 1.22, the impeller 16 has a dynamic ratio of 0.13 and the planetary reduction gear assembly 30 has a speed ratio of 512:1, all of which enable the housing structure 12 to be of an optimum minimum size. As shown, the housing structure can be made sufficiently strong out of light-weight plastic material. Preferably, in order to provide stability for the sprinkler, a dead weight in the form of a ball 108 is mounted within the housing structure.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a lawn sprinkler of the type including a fixed housing structure, an inlet in said housing structure adapted to be connected with a source of water under pressure, a water impeller rotatably mounted within said housing structure, means within said housing structure connected with said inlet for directing water under pressure communicated with said inlet onto said impeller in a direction to rotate said impeller, a sprinkler tube assembly having an exterior portion for directing streams of water under pressure onto an area to be sprinkled and an interior end portion disposed within said housing structure in a position to receive the water passing into said housing structure through said inlet including the water directed onto said impeller to rotate the same, means mounting said sprinkler tube for turning movements about a generally horizontally extending axis, an output shaft mounted in said housing structure for rotation about an axis parallel to the turning axis of said sprinkler tube and having an interior end portion within said housing structure and an exterior end portion outside of said housing structure, a reduction gear assembly mounted within said housing structure and drivingly connected between said impeller and the interior end of said output shaft, and a heart-shaped cam motion transmitting assembly disposed exteriorly of said housing structure drivingly connected between the exterior end portion of said output shaft, and the exterior of said sprinkler tube, the improvement which comprises said impeller having a dynamic impeller ratio defined by the ratio of the impeller diameter to the impeller tip speed of less than approximately 0.30, said reduction gear assembly having a gear reduction ratio of greater than approximately 400 to 1 and an effeciency of at least 26% and said motion transmitting mechanism having a heart-shaped cam with a cam factor defined by the expression $\pi r$ over K, where r is the radius of the pitch circle and K is the maximum cam rise, of less than approximately 3 so as to enable said housing structure to be an optimal minimum in size.

2. The improvement as defined in claim 1 wherein the axis of rotation of said impeller and the axis of rotation of said output shaft are coincident.

3. The improvement as defined in claim 2 wherein said output shaft includes a central exterior portion which is sealingly journaled in said housing structure.

4. The improvement as defined in claim 3 wherein said reduction gear assembly has an efficiency of 39% or greater and includes a multiplicity of rotating gears all of which are spur gears.

5. The improvement as defined in claim 4 wherein said reduction gear assembly includes a ring gear disposed in fixed relation with respect to said housing structure in concentric relation to the coincidental axis of said impeller and said output shaft.

6. The improvement as defined in claim 5 wherein said impeller is fixed to an impeller shaft one end of which is rotatably mounted in concentric relation to the interior end portion of said output shaft.

7. The improvement as defined in claim 6 wherein said reduction gear assembly includes a plurality of gear carriers spaced axially along said impeller shaft, said rotating spur gears including a plurality of sun gears of a number equal to the number of gear carriers mounted for rotation about the axis of said impeller shaft and a set of planetary gears rotatably carried by each gear carrier in meshing relation with a sun gear and said ring gear, one of said gear carriers being fixed to the interior end portion of said output shaft, one of said sun gears being fixed to said impeller shaft, each of the remaining sun gears being fixed to a remaining gear carrier.

8. The improvement as defined in claim 1 wherein said heart-shaped cam motion-transmitting assembly includes a cam member fixed to the exterior end portion of said output shaft having a heart-shaped exterior peripheral cam surface, a cam follower member having a central slot therein and a pair of cam surface engaging elements extending laterally therefrom in engagement with said peripheral cam surface, guide means carried by the exterior end portion of said output shaft for guided engagement within said slot.

9. The improvement as defined in claim 8 wherein said motion transmitting means includes an adjusting dial assembly between said cam follower sprinkler tube manually movable into a selected one of a plurality of adjusted positions for determining a plurality of different water pattern configurations for the water discharging from the outlets of said sprinkler tube.

10. The improvement as defined in claim 1 wherein the end portion of said sprinkler tube opposite from said interior end is rotatably supported by a runner assembly extending from said housing structure below said sprinkler tube in ground engaging relation.

11. The improvement as defined in claim 10 wherein said housing structure is molded of plastic material into two parts fixedly interconnected together.

12. The improvement as defined in claim 11 wherein said housing parts together define a sealed interior water containing space, one of said parts providing the rear wall defining said interior space which carries said inlet assembly, the other part providing the remaining walls defining said space including a front wall through which said output shaft and said sprinkler tube are mounted, said other housing part including an integral peripheral flange extending outwardly from and around the walls thereof between said front and rear walls and a peripheral shielding wall integrally fixed to the outer extent of said peripheral flange in spaced relation to the walls from which said flange extends.

13. The improvement as defined in claim 12 wherein said other housing part includes a pair of horizontally spaced forwardly opening socket defining walls fixed integrally to opposite sides of said peripheral shielding wall and extending downwardly therefrom so as to define a part of said runner assembly, said runner assembly also including a part molded of plastic material including an outer portion supporting said sprinkler tube having a pair of runners extending therefrom having end portions engaged within said forwardly opening sockets, and integral snap action means between said runner rear end portions and said sockets for fixedly retaining the same together.

* * * * *